United States Patent [19]

Lucarelli

[11] Patent Number: 4,487,511

[45] Date of Patent: Dec. 11, 1984

[54] WATCH FOR THE SPACE ORIENTATION IN ADDITION TO THE TIME ORIENTATION

[76] Inventor: Giancarlo Lucarelli, via Tasso, 179, Naples, Italy, 80127

[21] Appl. No.: 357,890

[22] Filed: Mar. 15, 1982

[51] Int. Cl.[3] ..... G04B 19/26

[52] U.S. Cl. ..... 368/15; 33/271

[58] Field of Search ..... 368/15-21, 368/223, 228; 33/1 H, 10, 269-271; 116/308, DIG. 43; 364/569, 705, 710

[56] References Cited

U.S. PATENT DOCUMENTS 4,136,397 1/1979 Pierce ..... 368/15 X 4,253,169 2/1981 Salah ..... 368/15

4,396,293 8/1983 Mizoguchi ..... 368/15

*Primary Examiner*—Vit W. Miska

*Attorney, Agent, or Firm*—Martin Smolowitz

[57] ABSTRACT

A watch adapted for use as a compass in addition to indicating local and remote times. The watch is provided with a dial, supplemental pointer, a microprocessor, and a keyboard for introducing selected data and operations into the microprocessor. The watch-compass and method is used for time and space orientation, in navigation such as for checking a magnetic compass or gyroscope, for calculation of azimuth angles, and for orientation of the user in unfamiliar locations.

1 Claim, 3 Drawing Figures

WATCH FOR THE SPACE ORIENTATION IN ADDITION TO THE TIME ORIENTATION

BACKGROUND OF INVENTION

The present invention pertains to a watch adapted for use as a compass in addition to indicating time, and to a method for use of the watch-compass to identify the North direction.

Regarding the actual state of the technique for watches, it is well known that there exists in commerce watches capable to maintain in addition to the local hour and date, also the hours and dates pertinent to other time zones and to keep many other functions. For usual navigation practice, the orientation is given by the magnetic or gyro compass and each necessitate a periodical check. In yachting navigation only the magnetic compass is mostly used, and it must be compensated for the deflecting effect of iron on board. This compensation operation is not simple and cannot be carried out in general by yachtsmen, not enough experienced for that; moreover that compensation must be checked often and adjusted because it is subject to change. Also in yachting navigation, the North direction, i.e. the orientation necessary to direct the boat when the coast is not in view, is generally a dangerously uncertain datum; yachtsmen cannot then accomplish with quiet mind short crossings of waters out of view of the coasts.

The proposed watch of the present invention provides on the contrary, sure indicators of direction. In professional navigation, this watch can be used as a new and continuous indicator of the astronomical azimuth A useful for the periodical checking of a compass. The orientation relative to the North direction can be also useful in zones of cities not well known to the user, and also in the woods, deserts, or ice covered areas.

SUMMARY OF INVENTION

The present invention discloses a watch provided with a supplementary pointer, a microprocessor and completed by a keyboard to introduce numbers into the microprocessor. The invention also includes use of the microprocessor for a particular orientation of the supplementary pointer, and use of this watch as a compass to identify the North direction. This watch-compass also indicates digitally the angle of orientation of the supplementary pointer and also gives the sidereal and Greenwich mean time, useful to navigators. The watch-compass according to the invention can be useful in navigation to check a magnetic compass or a gyro compass and in yachting navigation for emergency uses. Such a watch can be useful in all the frequent circumstances when the magnetic compass is unreliable, damaged or absent. The watch-compass can also be useful for the user's orientation in unfamiliar cities.

DESCRIPTION OF INVENTION

Figure 1:
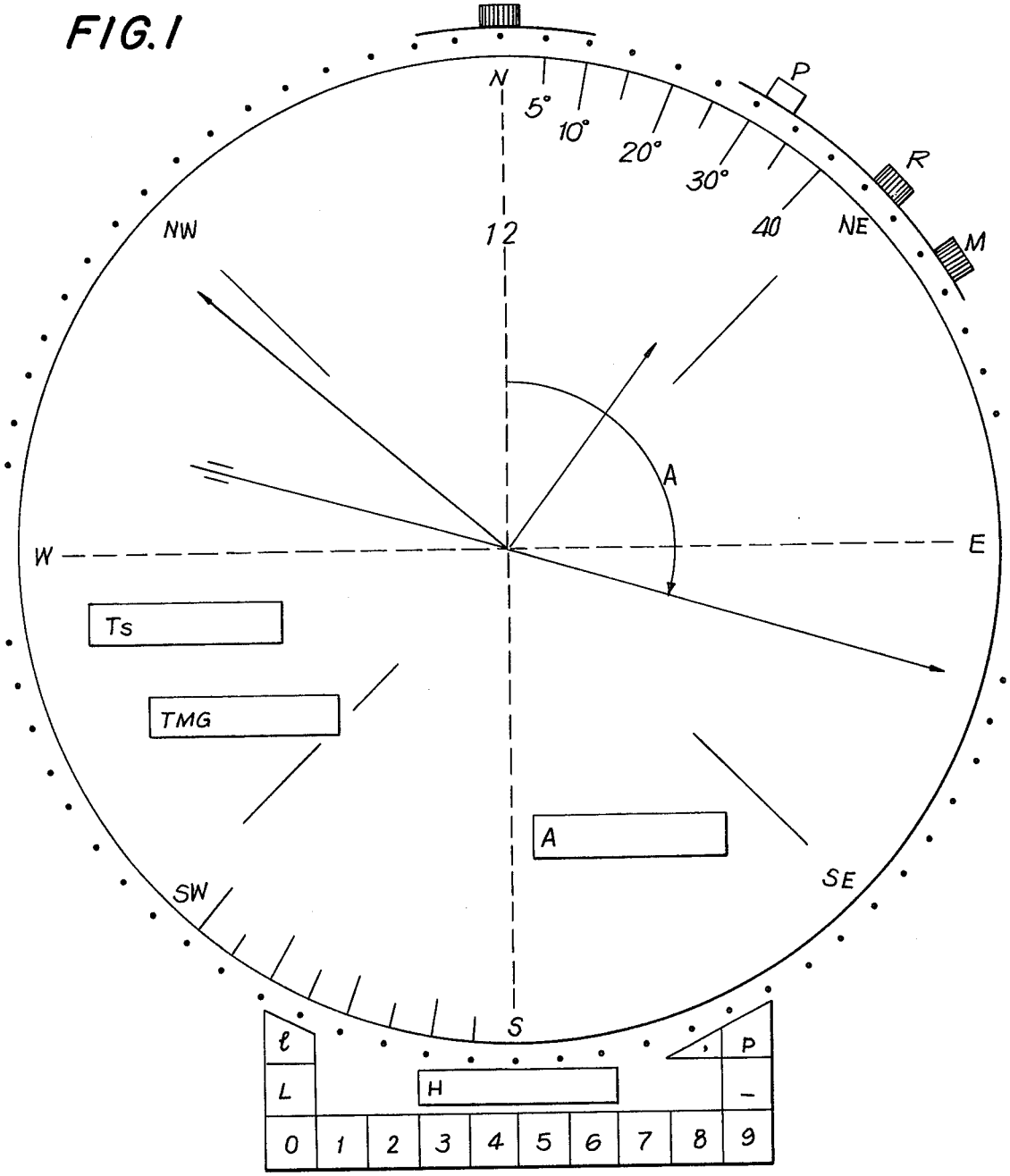
FIG. 1 is a plan view of the watch face showing the dial, supplementary pointer and microprocessor keyboard unit according to the invention.

As generally shown in FIG. 1, the watch is provided with a dial and two main pointers, a supplementary pointer (S), a microprocessor, and a keyboard having at least fifteen keys (or preferably seventeen keys for further performance). Ten of the keys are for the introduction of numbers, digits from zero to nine, into the microprocessor. One key is for the introduction of the decimal point, one key for the introduction of the minus sign, one key to indicate that the introduction of the number is to be performed in a memory register for the latitude (l), one key to indicate that the introduction is to be performed in a memory register for the longitude (L). An inexperienced user also will be able to obtain his own latitude and longitude information by a common geographic or nautical map; it suffices to use an approximation to some teneths of degree when it is not possible to be more accurate. We shall describe later the third memory register (p), and also the other two keys for further performances. When the minus key is not pressed, the number will be considered to be a positive one. The data inserted can be eventually visualized in a window, shown at H in FIG. 1, for checking the correct introduction of data.

By pressing of a key P, the microprocessor will calculate the angle A according to which the pointer S is to be oriented (angle A extending between 12 hour location and the pointer S, from zero to 360 degrees in the sense of increasing hours). This angle A, that is time variable, will be automatically brought up to date each few minutes, i.e. each two minutes, by the microprocessor until the user will again press the key P. The angle A will also be shown in window H. As a result of these computations and updatings, the pointer S will be oriented, usually automatically but if desired also by hand, according to said angle A. By now setting the watch dial horizontal and by pointing the pointer S towards the celestial body concerned (we are now concerned with the Sun but later will discuss the cases of the Moon, the stars or the planets), the zero of the graduation of the watch dial (at 12 hours) will then point to the North.

Another possible use for the present watch-compass is to find one's bearings in cities by utilizing, if the Sun is not in view, the shadows of the buildings, or the shadows of one's body or shadows of other objects.

The watch must maintain Greenwich hour (GMT) and date, as it is necessary that the usual two pointers give the local hour or time, and said data relative to Greenwich time should be shown digitally (FIG. 1). In addition to the Greenwich mean time (GMT), this watch also maintains the Greenwich sidereal time Ts; and this would also be useful for the navigator. Ts is to be shown digitally in a window (FIG. 1). The capability to maintain simultaneously these two times can be got by only one oscillator considering that one sidereal day (equal to 360° variation of Ts) is equivalent to 23 hours 56 minutes 4.091 seconds of mean time (GMT); or well for each mean day-(variation of 24 hours of GMT) Ts varies of $360°.9856472 = 360°59'.14$. The indication of Ts in the window must be adjusted by the key R to reset the correct correspondence between GMT and Ts; the corresponding values of these may be taken by a common nautical or astronomical almanac.

To get the indication of the North direction, the user has to insert, by the keyboard in FIG. 1, his latitude l and longitude L, in degrees and minutes of arc with their proper sign (any omitted sign must be considered to be plus). The signs must be plus for latitude North and longitude East; they must be minus for latitude South and longitude West. The memory can be of the continuous kind for uses in limited areas, to insert una tantum such data, eventually at the time of purchase of the watch. Once such data is inserted, the user must press the key P. The inside microprocessor will then execute the operations shown in FIGS. 2 and 3.

We shall now describe operation of the numerically labeled blocks of FIG. 2 and 3, as follows:

(1) By TMG the conversion of GMT from hours, minutes, and seconds to degrees and fractions is indicated, by the equivalence: 24 hours=360 degrees.

(2) Conversion of Ts from degrees, minutes, and seconds of arc to degrees and fractions.

(3) p is the celestial longitude of the perigee in the solar appearant orbit; it grows of about 1′ (one minute of arc) each year, that is equal to two hundredths of a degree each year. In 1981 we can assume a value of 281° 17′ equal to 281.28°; in 1982 a value of 281° 18′, equal to 281.30°. This value can be inserted into the microprocessor by the numerical keyboard and the key p each year, ot it can be adjusted automatically. In the diagram it is intended to be expressed in degrees and fractions.

(4) Em can be calculated at two decimal digits.

(5) In this point it must be connected the preceeding calculation process for the going on and the conclusion of the calculations, or it can be the beginning of the calculations in the case of a more complete instrument for the use relative to Moon, planets or stars in addition to Sun (and for users having a little experience in navigation). In this more advanced instrument, it is possible to insert also the declination d and hour angle relative to Greenwich Time T of the considered celestial body in suitable memory registers by using two additional keys. In this case the user, in addition to his own coordinates of latitude 1 and longitude L, may insert also d and T, taking them from an ephemerides. This additional insertion will also be the signal that the calculation must start from this point.

(6) L must be in degrees and fraction.

Figure 2:
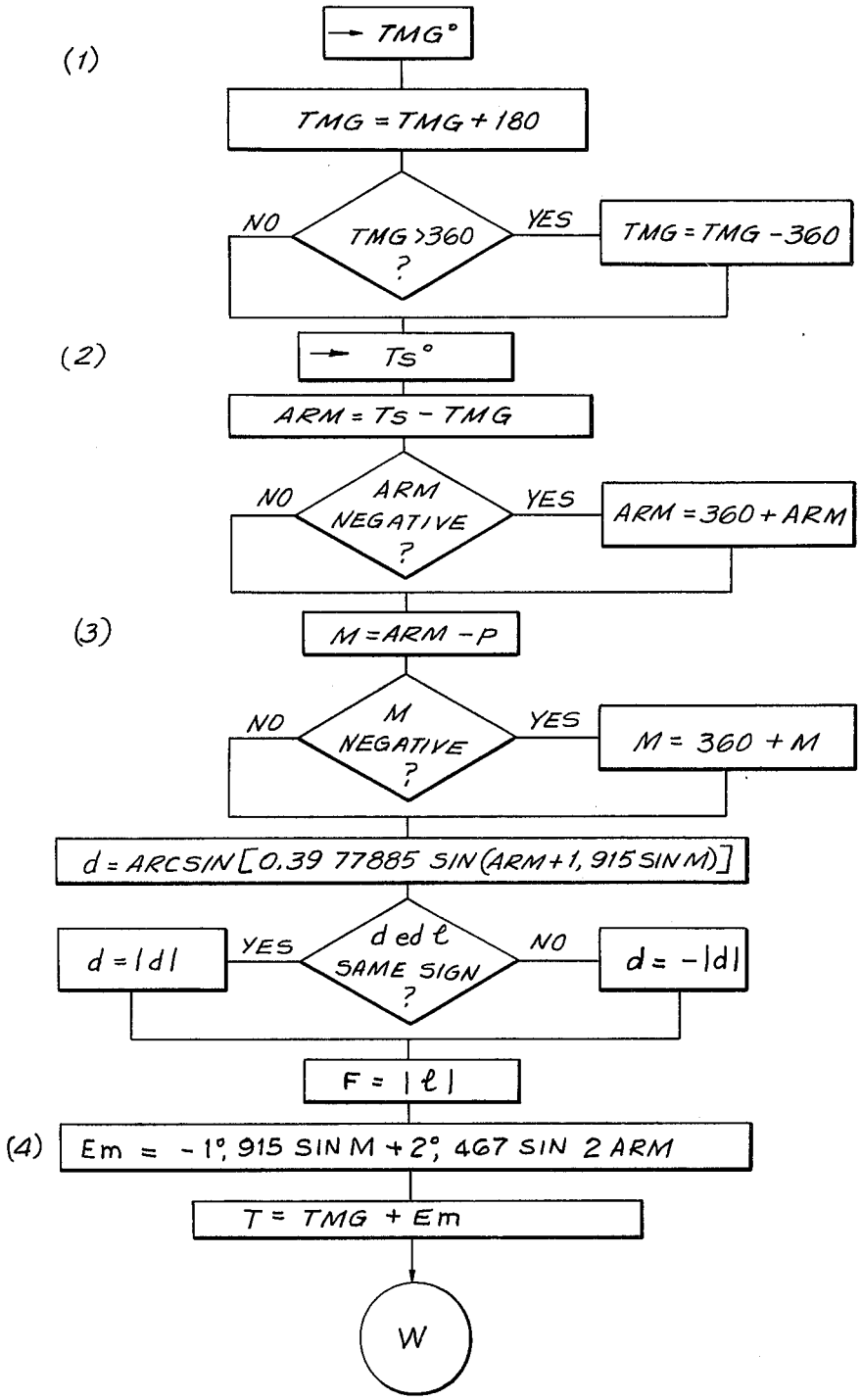
FIGS. 2 and 3 show flow diagrams for computations made by the microprocessor during use of the watch-compass.
Figure 3:
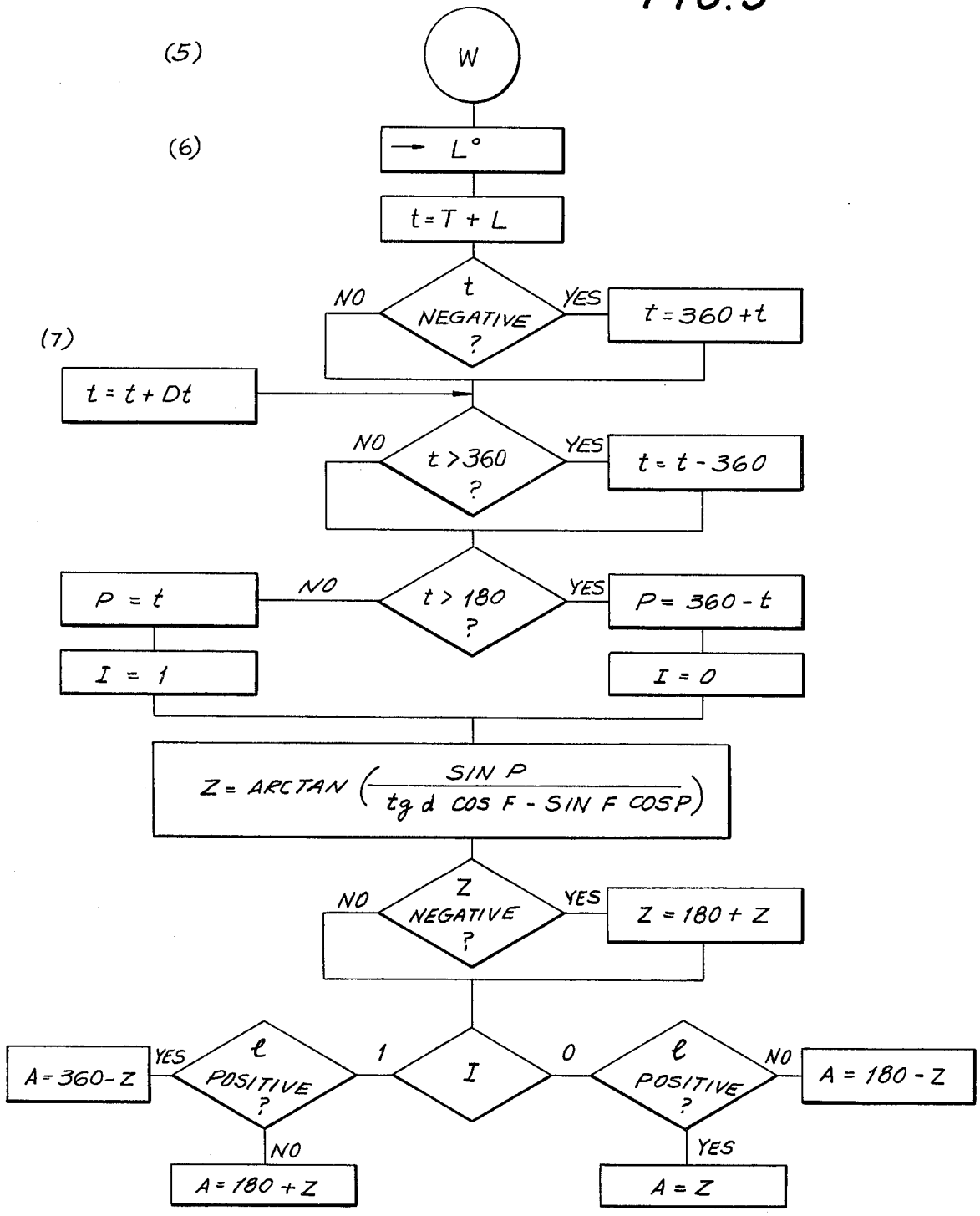

(7) After the pressing of key P the microprocessor will execute firstly all the operations indicated in the diagrams of FIGS. 2 and 3; after intervals of some minutes, till a new pressing of the key P, the microprocessor will repeat the calculations starting not from the beginning but from this point under discussion (7), after having updated the preceeding value t (it shall then be preserved) by adding to it a quantity Dt that is a conversion in degrees of the repetition interval of the calculations (for a two minutes interval that is suitable, Dt=0.5). These shortened repetitions are not quite precise, and if continuous indications are wished for much time, after some hours it will be appropriate to press the key P to stop the repetitions, and then to press it again to start again the calculations from the beginning.

I claim:

1. A watch-compass useful for time and space orientation, said watch-compass comprising:

(a) a dial having two main pointers for indicating local time;

(b) a supplemental pointer located on said dial, said supplemental pointer being able to indicate on the dial an azimuth angle of a selected celestial body;

(c) a microprocessor associated with the watch and used for calculating said azimuth angle; and (d) a keyboard attached to said watch for introducing numbers and data into said microprocessor for calculation of said azimuth angle.

* * * * *